United States Patent [19]

Adams et al.

[11] Patent Number: 4,889,294

[45] Date of Patent: Dec. 26, 1989

[54] YARN CARRIER WITH INTERCHANGEABLE IDENTIFYING RING

[75] Inventors: Samuel F. Adams; Hans-Peter Bolz, both of Greenville, S.C.

[73] Assignee: Sonoco Products Company, Hartsville, S.C.

[21] Appl. No.: 272,735

[22] Filed: Nov. 17, 1988

[51] Int. Cl.[4] ..... B65H 75/10

[52] U.S. Cl. ..... 242/118.3; 40/309; 242/118.32

[58] Field of Search ..... 242/118.3, 118.31, 118.32; 40/309

[56] References Cited

U.S. PATENT DOCUMENTS

| | | | |
|---|---|---|---|
| 201,763 | 3/1878 | Essex | 242/118.32 |
| 745,948 | 12/1903 | Wilson | 242/118.31 |
| 778,033 | 12/1904 | Berlizheimer | 242/118.32 |
| 1,367,639 | 2/1921 | Tiffany | 242/118.32 |
| 1,858,410 | 5/1932 | Morey | 242/118.32 X |
| 2,006,797 | 7/1935 | Dunlap | 242/118.32 |
| 2,026,032 | 12/1935 | Gottlieb | 242/118.3 X |
| 2,359,604 | 10/1944 | Atwood | 242/118.31 X |
| 2,403,417 | 7/1946 | Van Deventer | 242/118.31 |
| 2,419,415 | 4/1947 | Morf | 242/118.31 |
| 2,535,188 | 12/1950 | Beckner | 242/118.32 |
| 2,879,010 | 3/1959 | Crawford | 242/118.32 |
| 2,958,145 | 11/1960 | Curry | 40/309 |
| 3,033,489 | 5/1962 | Morris | 242/118.32 |
| 3,328,907 | 6/1967 | Burgess et al. | 40/309 |
| 3,425,149 | 2/1969 | Fletcher | 40/309 |
| 3,450,370 | 6/1969 | Hawkins | 242/118.32 |
| 3,592,407 | 7/1971 | Hagmann et al. | 242/118.3 |
| 3,628,747 | 12/1971 | Bakewell | 242/118.32 |
| 3,946,866 | 3/1976 | Turnage | 206/392 |
| 4,245,799 | 1/1981 | Allen, Jr. | 242/118.3 |

FOREIGN PATENT DOCUMENTS

| | | | |
|---|---|---|---|
| 533223 | 12/1921 | France | 242/118.31 |
| 3143 | of 1912 | United Kingdom | 242/118.31 |
| 226683 | 1/1925 | United Kingdom | 242/118.3 |
| 334317 | 9/1930 | United Kingdom | 242/118.31 |

*Primary Examiner*—Stanley N. Gilreath

*Attorney, Agent, or Firm*—Bell, Seltzer, Park & Gibson

[57] ABSTRACT

This invention is directed to a yarn carrier with means for visually indicating the type of yarn wound onto the carrier. In particular the indicator is a color coded ring which is received in a channel at the end of the yarn carrier. This arrangement provides a clear visible indication of the type of yarn on the carrier while not adding to the length or diameter of the carrier. As such the critical dimensions of the carrier are assured while providing a simple convenient indication of the type of yarn.

13 Claims, 1 Drawing Sheet

YARN CARRIER WITH INTERCHANGEABLE IDENTIFYING RING

FIELD OF THE INVENTION

This invention is directed to a yarn carrier with an identification ring for particularly identifying the type of yarn wound onto the yarn carrier, and more particularly to a yarn carrier which includes a ring that is clearly visible and does not effect the length of the carrier, or either the outside or inside profile at the nose of the carrier.

BACKGROUND OF THE INVENTION

In production textile mills, a wide variety of yarns are used to produce an array of textile products. Unfortunately, many textile yarns are not easily distinguishable from one another. Therefore, the yarn packages must be carefully labelled or maintained in compartments or racks that are clearly marked.

One approach to handling this problem is to provide yarn carriers with color coded markings or attachments such as described in U.S. Pat. No. 3,033,489 to Morris. Morris discloses a yarn carrier which includes a color coded bushing inserted into the end of the tube. The bushing includes a flange at the outer end which extends out from the end of the tube to be easily visible. One particular drawback with this arrangement is that the overall length and the inside diameter of the carrier are changed by the addition of the bushing. The change in length or the change in the inside diameter may cause the carrier to be unusable with existing holders and the like, and thus the use of such a carrier may necessitate costly machine changes.

Other proposals for providing color coded indicators to a yarn carrier include U.S. Pat. Nos. 2,026,032, 3,425,149 and 1,858,410. The indicators of these carriers, like Morris above, extend the length of the yarn carrier. As such, these carriers would be unacceptable for similar reasons as discussed above. U.S. Pat. No. 2,026,032 not only extends lengthwise, but also radiates out from the carrier. In some applications, the outside diameter is a critical dimension so this indicator would be unusable for further applications.

Accordingly, it is an object of the present invention to provide a yarn carrier with means for indicating the type of yarn wound thereon and which avoids the drawbacks of the prior art as discussed above.

It is another object of the present invention to provide a yarn carrier which has provision for identifying the yarn wound thereon, and which minimizes inventory costs by providing a removable ring for identifying the yarn. Thus the carriers may be standardized, with only the rings being different.

It is a further object of the present invention to provide a yarn carrier including a ring for indicating the type of yarn wound on the carrier and which is received in a manner that does not change the overall length of the carrier, or either the outside diameter or the inside diameter of the carrier.

SUMMARY OF THE INVENTION

The above and other objects of the invention are achieved by a yarn carrier comprising a tube having opposite ends and a peripheral wall for receiving the yarn to be wound thereon. An external annular channel is formed into the peripheral wall so as to communicate with one of the ends of the tube. The channel includes an annular groove adjacent the side of the channel distal from the one end of the tube and the groove extends radially inwardly a distance greater than the remainder of the channel. The carrier further comprises a resilient ring having a particular identifying characteristic and which is positioned within said external annular channel. The ring also has an annular rib extending radially inwardly into the groove in the channel for grippingly engaging the tube. In this position, the ring does not extend beyond the end of the carrier and the outer surface of the ring extends approximately flush with the peripheral wall of the tube.

BRIEF DESCRIPTION OF THE DRAWINGS

Some of the objects have been stated and other objects will appear as the description proceeds when taken in conjunction with the accompanying drawings in which.

DETAILED DESCRIPTION OF THE PREFERRED EMBODIMENT

Figure 1:
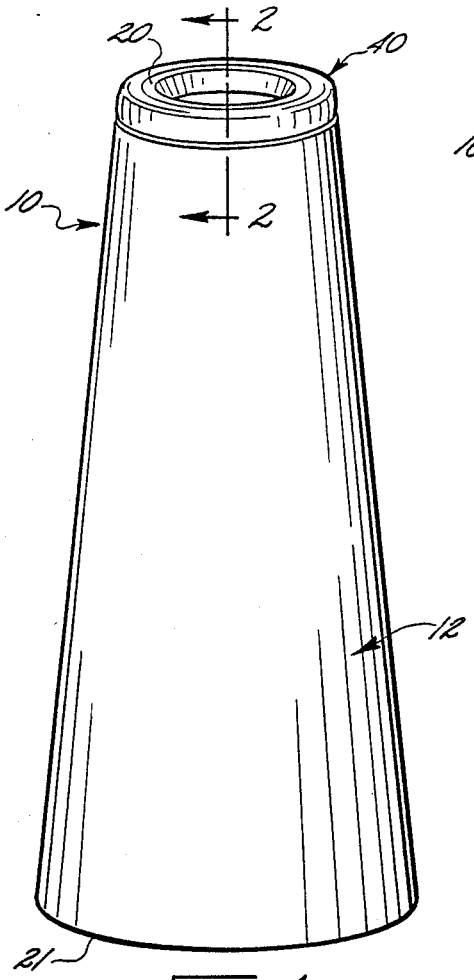
FIG. 1 is a perspective view of a yarn carrier embodying the features of the present invention.
Figure 2:
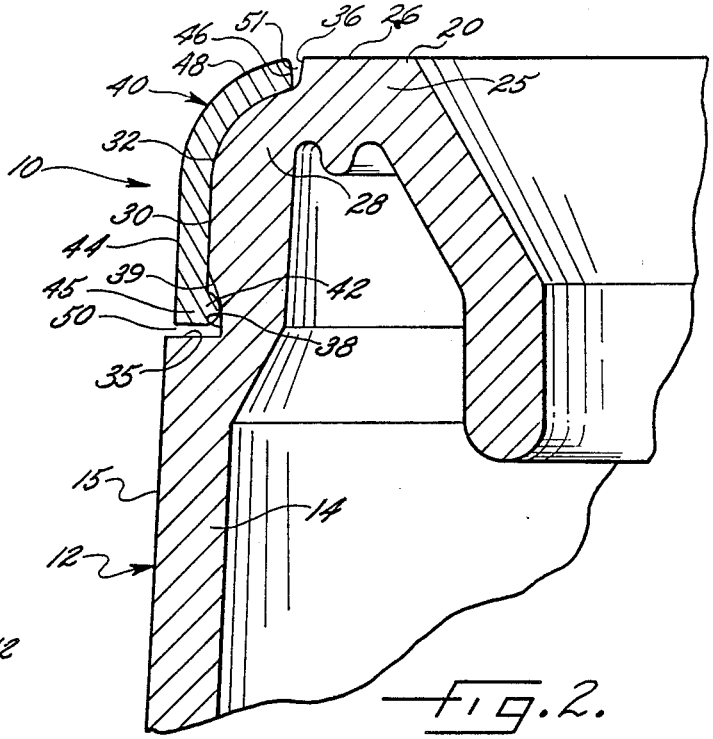
FIG. 2 is a cross-section view of the yarn carrier taken along line 2—2.
Figure 3:
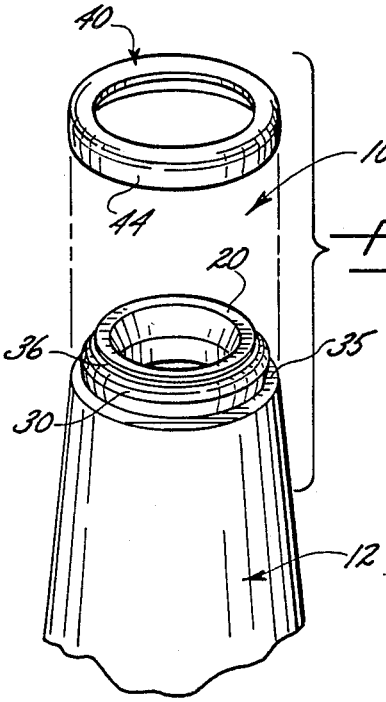
FIG. 3 is an exploded perspective view of the yarn carrier illustrating how the ring fits onto the end of the tube.

Referring now more particularly to the drawings, FIGS. 1, 2 and 3 illustrate a first embodiment of a yarn carrier generally indicated by the reference numeral 10. The yarn carrier 10 comprises a generally elongate conical tube 12 adapted to be mounted on a winding machine and have a yarn wound thereon to form a yarn package. The tube 12 is typically fabricated from molded plastic, and it has a peripheral wall 14, which defines an outer peripheral surface 15 upon which the yarn is wound, and first and second opposite ends 20 and 21. Positioned at the nose or first end 20 of the tube 12 is an end wall 25 which extends radially inwardly from the peripheral wall 14 and defines an outer end surface 26. The intersection of the end wall 25 and the peripheral wall 14 defines a corner juncture 28.

An external annular channel 30 is formed into the outer peripheral surface 5 and the outer end surface 26 adjacent the corner juncture 28. The annular channel 30 defines a base surface 32 recessed from and extending along the outer peripheral surface 15, the corner juncture 28 and the outer end surface 26. At opposite edges of the external annular channel 30 are a first and second annular shoulders 35 and 36. The first annular shoulder 35 is at the end of the channel 30 distal from the first end 20 of the tube and extending substantially perpendicularly with and between the outer peripheral surface 15 and the base surface 32. The second annular shoulder 36 is at the end of the channel distal from the peripheral wall 14 extends substantially perpendicularly with and between the outer end surface 26 and the base surface 32. The annular channel 30 further includes an annular groove 38 adjacent the first annular shoulder 35 and which extends radially inwardly from the base surface 32. The annular groove 38 has an inclined surface 39 on the side thereof opposite from the first annular shoulder 35, and which extends between the base of the groove 38 and the base surface 32.

The yarn carrier 10 further includes an interchangeable resilient annular ring 40 having a cross sectional configuration closely conforming to and positioned within the external annular channel 30. The ring 40 is preferably formed of molded plastic and it is sized so as to substantially overlie the entire channel 30. The ring also includes an annular rib 42 which extends radially inwardly from the ring 40 into the annular groove 38 to grippingly engage the tube 12.

With the described arrangement, the ring is easily visible from the end of the carrier 10 as well as from any side thereof, even when a yarn is wound on the carrier. This is desirable, because the ring 40 has a particular identifying characteristic to identify the type of yarn wound on the carrier. In the preferred arrangement, various colors are selected to identify particular yarns. For example, a kelly green ring may be used to indicate nylon 66 yarn. However, other visual indications such as a combination of colors, etc. may alternatively be used. The ring 40 is adapted to be axially removable from the annular channel 30 by exertion of an axial force to the ring 40 which is sufficient to spring the annular rib 42 from the annular groove 38. The process of axially removing the ring 40 is further facilitated by the configuration of the channel. In other words, since the channel 30 extends around the corner juncture 28, the channel 30 in effect communicates with the first end 20 and does not impede axial movement of the ring 40. Once removed, a ring of a different color may be substituted for the removed ring.

The ring 40 further includes first and second end portions 45 and 46 which define end surfaces, and such that these end surfaces are spaced respectively from the first and second annular shoulders 35 and 36 to define first and second gaps 50 and 51, respectively, when the ring is positioned within the channel 30. These gaps 50 and 51 accommodate some movement of the ring in the channel, so for instance, if the carrier where to collide with another object on the ring, the ring would be able to absorb some of the shock by slipping along the channel. The gap 50 also is designed to accommodate a tool or other object to facilitate the axial removal of the ring 40. Removal of the ring 40 is further facilitated by the inclined surface 39 which urges the annular rib 42 radially outward from the groove 38 as the ring 40 moves axially off the tube 12.

It is also important that while the ring is visible, it should not project out from the tube in any direction particularly beyond the first end 20. More specifically, the ring 40 has an outer surface portion 44 adjacent the end portion 45 that is arranged to extend approximately flush with the outer peripheral surface 15. A second outer surface portion 48 adjacent the end portion 46 of the ring is approximately flush with the outer end surface 26.

A particular feature of the first embodiment of this invention is the rolled nose configuration of the ring 40. The ring 40 and the base surface 32 of the channel 30 are both arcuately curved at the corner juncture 28 to present a rolled nose which may be necessary to cooperate with certain textile machines. Also, the inner surface of the ring is contiguous with the base surface 32 along substantially the entire width of the channel 30.

Figure 4:
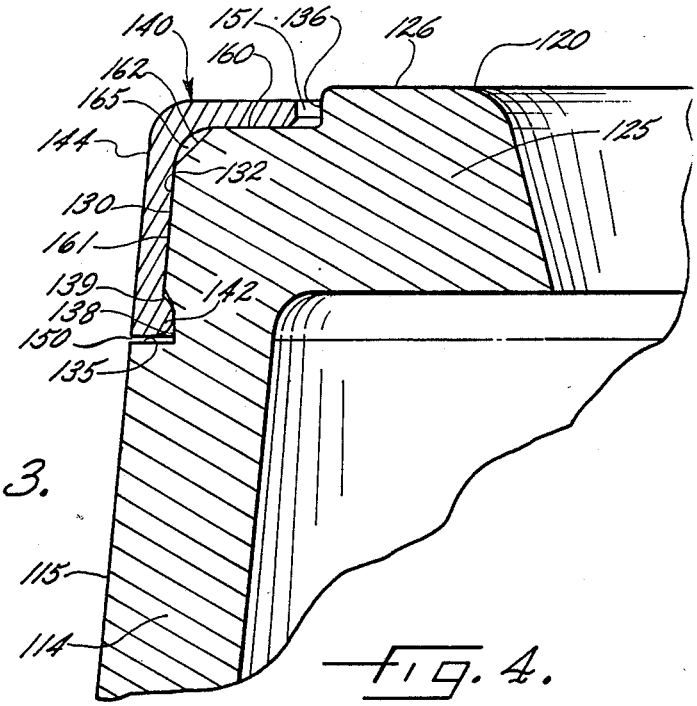
FIG. 4 is a cross section view similar to FIG. 2 illustrating a second embodiment of the yarn carrier.

A second embodiment of this invention is illustrated in FIG. 4. For the second embodiment, elements that are similar to elements in the first embodiment are indicated by the same reference numeral with the addition of 100. For example the ring is indicated by the numeral 40 in FIG. 2 and is indicated by the numeral 140 in FIG. 4.

In this second embodiment, the tube is formed with a relatively thick peripheral wall 114, so as to provide durability. In this regard, the carrier 10 of FIGS. 1–3 is designed to be used once and thrown away, and thus the yarn carrier 10 is made as inexpensively as possible. As such, the thickness of the peripheral wall 14 in FIG. 2 is relatively thin. In contrast, the wall 114 in the embodiment of FIG. 4 is much thicker. The carrier illustrated in FIG. 4 would be more expensive to manufacture, but it is designed to last for repeated uses. A second difference of the second embodiment is that the ring 140 and the base surface 132 of the channel 130 are configured somewhat differently. In particular, ring 140 and bas surface 132 do not have quite the rounded configuration as the ring 40, but rather each has a cross section which more closely resembles an inverted "L". The ring 140 and the base surface 132 include overlying first and second portions 160 and 161 which are disposed at substantially right angles to each other. The base surface 132 further includes an inclined portion 162 extending between the first and second portions 160 and 161 adjacent the corner juncture 128. An open space 165 is defined between a medial portion of the ring 140 and the inclined portion 162 for absorbing shock such as from an impact on the ring, to thereby avoid damage to the carrier.

In the drawing and specification there has been set forth preferred embodiments of the invention and although specific terms are employed they are used in a generic and descriptive sense only and not for purposes of limitation.

That which we claim is:

1. A yarn carrier adapted to be mounted on a winding machine to have a yarn wound thereon to form a yarn package, said yarn carrier comprising:

a tube having opposite ends, a peripheral wall defining an outer peripheral surface for receiving the yarn to be wound thereon, an external annular channel formed into said outer peripheral surface and communicating with one of said ends, with said channel including an annular groove adjacent the side of said channel distal from said one end and wherein said annular groove extends radially inwardly a distance further than the distance that the remainder of said channel extends radially inwardly, said annular groove having an inclined annular surface sloping outwardly and in the general direction of said one end;

a resilient ring having a particular identifying characteristic and positioned within said external annular channel and having an inwardly extending annular rib extending into said annular groove for grippingly engaging said tube, and wherein said ring does not extend beyond said one end of the tube and said ring further has an outer surface portion which extends approximately flush with said outer peripheral surface of said tube, and said annular rib having a rounded inner surface positioned in opposing relation to said inclined surface and cooperating with said inclined surface for facilitating manual removal of said ring by the exertion of an axial force on the ring so as to move said rounded inner surface of said annular rib along said inclined surface.

2. The yarn carrier according to claim 1 wherein said tube further comprises an end wall positioned at said one end of the tube and extending radially inwardly from said peripheral wall.

3. The yarn carrier according to claim 2 wherein said peripheral wall and said end wall define a corner juncture at the intersection thereof, and said end wall defines an outer and surface, and wherein said external annular channel is also formed into said outer end surface, such that said channel extends along said outer peripheral surface, around said corner juncture, and along said outer end surface; and further wherein said ring is sized so as to substantially overlie the entire channel.

4. The yarn carrier according to claim 2 wherein said ring has an additional outer surface portion adjacent said one end of said tube which lies approximately flush with said outer end surface.

5. The yarn carrier according to claim 2 wherein said ring is arcuately curved to present a rolled nose at said corner juncture of the yarn carrier.

6. The yarn carrier according to claim 2 wherein said ring has an inner surface which lies substantially contiguous with a base surface defined by said annular channel.

7. The yarn carrier according to claim 2 wherein said ring has an inner surface which lies substantially contiguously with said channel except for a medial portion adjacent said corner juncture, thereby forming a space for absorbing shock such as from an impact on the ring.

8. The yarn carrier according to claim 1 wherein said particular identifying characteristic of the ring is the color thereof.

9. A yarn carrier adapted to be mounted on a winding machine to have a yarn wound thereon to form a yarn package, said yarn carrier comprising a tube having opposite ends, a peripheral wall defining an outer peripheral surface for receiving the yarn to be wound thereon, an end wall positioned at one end of said tube and extending radially inwardly from said peripheral wall, with said end wall defining an outer end surface, and with said peripheral wall and said end wall defining a corner juncture at the intersection thereof, an external annular channel formed in said tube at said corner juncture, said channel defining a base surface, a first annular shoulder at the end of said channel distal from said one end of said tube and with said first annular shoulder extending substantially perpendicularly with and between said base surface and said outer wall surface, and a second annular shoulder extending substantially perpendicularly with and between said base surface and said outer end surface, and with said base surface including an annular groove adjacent said first annular shoulder and which extends radially inwardly a distance further that the distance that the remainder of said channel extends radially inwardly, said annular groove having an inclined annular surface sloping outwardly and in the general direction of said one end, a resilient annular ring having a particular identifying characteristic and positioned within said annular channel, said ring having a cross sectional configuration closely conforming to that of said base surface of said channel, and further including an inwardly extending annular rib extending into said annular groove for grippingly engaging said tube, and said annular rib having a rounded inner surface positioned in opposing relation to said inclined surface and cooperating with said inclined surface for facilitating manual removal of said ring by the exertion of an axial force on the ring so as to move said rounded inner surface of said annular rib along said inclined surface.

10. The yarn carrier as defined in claim 9 wherein said annular ring has a first end surface opposing said first shoulder of said channel in a slightly spaced apart arrangement to define a gap therebetween, with said gap being adapted to receive a tool to facilitate the axial removal of said ring from said channel.

11. The yarn carrier as defined in claim 10 wherein said annular ring has a second end surface opposing and immediately adjacent to said second shoulder.

12. The yarn carrier as defined in claim 9 wherein said base surface of said channel and said ring are arcuately curved at said corner juncture.

13. The yarn carrier as defined in claim 9 wherein said ring has an outer surface portion which extends substantially flush with said outer peripheral surface of said tube, and so that the ring does not extend radially beyond said outer peripheral surface.

* * * * *